United States Patent [19]

Dacey, Jr.

[11] Patent Number: 4,934,226

[45] Date of Patent: Jun. 19, 1990

[54] SOCKET DRIVER TOOL

[75] Inventor: Ernest A. Dacey, Jr., Highland, Mich.

[73] Assignee: Utica Enterprises, Inc., Sterling Heights, Mich.

[21] Appl. No.: 346,254

[22] Filed: May 1, 1989

Related U.S. Application Data

[63] Continuation of Ser. No. 180,351, Apr. 11, 1988, abandoned.

[51] Int. Cl.[5] ..... B25B 13/00

[52] U.S. Cl. ..... 81/125; 279/22

[58] Field of Search ..... 81/125; 279/1 B, 76, 279/79, 80, 102, 103, 16–17, 22–24, 30

[56] References Cited

U.S. PATENT DOCUMENTS

| | | | |
|---|---|---|---|
| 2,154,738 | 4/1939 | Fisher | 279/76 |
| 2,367,480 | 1/1945 | Beswick . | |
| 2,985,049 | 5/1961 | Vilmerding . | |
| 3,142,211 | 7/1964 | Faso | 81/125 |
| 3,987,336 | 3/1974 | Howe . | |

FOREIGN PATENT DOCUMENTS

| | | | |
|---|---|---|---|
| 996686 | 9/1951 | France | 81/125 |
| 224429 | 11/1924 | United Kingdom | 81/125 |

*Primary Examiner*—D. S. Meislin
*Attorney, Agent, or Firm*—Remy J. VanOphem

[57] ABSTRACT

A socket tool for multi-faced fasteners such as nuts, bolts, and the like, having at least one resiliently biased rollably mounted retainer pin which interacts with at least one face of the multi-faced fastener to keep the multi-faced fastener received by the socket of the socket tool in axial alignment therewith irrespective of the orientation of the socket. An hexagonally shaped socket is preferred, having a resiliently biased rollably mounted retainer pin in every other face of the socket. An annular flange is provided integral with the socket wall. The annular flange has an annular slot along its periphery and further has a cut-out contiguous along every other face of the socket. Each cut-out has a width exceeding the width of the face of the socket to which it is contiguous. A retainer pin is located in each cut-out adjacent the socket. A retainer key having a straight edge and a curved edge is located in the retainer slot, the straight edge abutting the retainer pin. At least one resilient ring is located in the annular slot of the annular flange and biases against the curved edge of the retainer key causing the retainer pin to resiliently protrude into the socket, the adjacent socket walls serving as an abutment for the retainer pin.

15 Claims, 2 Drawing Sheets

SOCKET DRIVER TOOL

This is a continuation of application Ser. No. 07/180,351, filed Apr. 11, 1988 now abandoned.

BACKGROUND OF THE INVENTION

1. FIELD OF THE INVENTION

This invention pertains to a socket tool used in conjunction with drivers for driving bolts, nuts, and the like and, more particularly, to a socket tool having a retaining device for keeping a received bolt, nut and the like in alignment with the axis of the socket of the socket tool independent of the orientation of the socket.

2. DESCRIPTION OF THE PRIOR ART

It is well known in the art to fasten together two or more structures by use of a bolt and nut combination, or other like fasteners, such as lag screws. The bolt, nut, and the like are provided with a multi-faced portion, typically of square or hexagonal shape, for interfacing with a complementary shaped socket of a socket tool.

There has been, and continues to be, a longstanding problem in the relevant art to devise a cost effective and reliable retainer device for bolts, nuts and the like, hereinafter referred to as multi-faced fasteners, with regard to the sockets of socket tools, such as those used in ratchet wrenches and automated machine tools. This problem has plagued the art because there must be a small amount of play between the surfaces of the multi-faced fastener and the socket in order to facilitate easy insertion and removal of the multi-faced fastener relative to the socket. As a result, there is frequently a tendency for the multi-faced fastener to fall entirely out of the socket in situations where the socket is oriented vertically downward, resulting in the multi-faced fastener depending from the socket. This situation is of great concern to a mechanic, since it can frequently result in the loss of the multi-faced fastener into an inaccessible location of the work piece. As a result further, there is frequently a tendency, when the multi-faced fastener is of male configuration, as represented by a bolt, lag screw or the like, for the male multi-faced fastener to droop out of axial alignment with the socket when the socket is oriented in other than a vertical orientation, especially a horizontal orientation. This situation can occur with female configured multi-faced fasteners, such as nuts, but to a lesser degree. Droop is of great concern to manufacturers and users of automated machinery incorporating automatic drivers because alignment of the multi-faced fastener relative to the socket in which it is received is critical with respect to trouble free threading of the multi-faced fastener into precisely located apertures of the components of a work piece undergoing assembly.

Many solutions to this problem have been devised in the prior art, each of which in some manner modify the socket to effect retention of the multi-faced fastener thereinto. These solutions fall into three broad categories: biased retainer devices which abut the faces of the multi-faced fastener, frictional spacer retainer devices which also abut the faces of a multi-faced fastener and, finally, retainer devices which overlappingly interfere above and below the multi-faced fastener.

The first class of retainer devices is represented by U.S. Pat. No. 2,805,594 to Fogel which teaches a wrench socket provided with a slot into which a folded projection protrudes thereinto. The folded projection is mounted on a resilient spring steel annular ring which slips over the periphery of the wall of the socket. When a multi-faced fastener is inserted into the socket, the folded projection biases against one face of the multi-faced fastener, causing it to be retained in the socket. Other examples of this class of retainer devices include: U.S. Pat. No. 2,953,049 to Vilmerding and British Pat. No. 211,036 to McCarthy which disclose biasing a multi-faced fastener by a plurality of face abutting spring biased spherical balls; U.S. Pat. No. 3,005,367 to Vose which discloses an annular resilient ring which biases face abutting spherical balls; and U.S. Pat. No. 3,142,211 to Faso which discloses a slotted socket around which a U-shaped spring steel retainer is located so as to contact a multi-faced fastener when it is received into the socket. This first class of retainer devices suffers from the disadvantage that a bolt received by one of these modified sockets can droop for certain orientations of the socket because the retainers used do not abut the faces of the bolt head along a line perpendicular to the axis of the socket, but rather abut the faces of the bolt head either only at a point location or along a line parallel with the axis of the socket.

The second class of retainer devices is represented by U.S. Pat. No. 3,630,107 to Carr which teaches a spring keeper having an annular ring portion for clipping onto the periphery of the socket and a U-shaped portion, a part of which is structured to protrude into the socket. The protruding part is located in a groove of the socket and presses against a face of an inserted multi-faced fastener. Other examples of this class of retainer devices include: French Pat. No. 996,686 which discloses frictional interference members on the walls of the socket; U.S. Pat. No. 2,634,641 to Hodges which discloses a slotted socket over which a flared sleeve is slid to secure a received multi-faced fastener; U.S. Pat. No. 3,665,791 to Carr which discloses a resilient wire keeper that has two extension members that insert into the socket; U.S. Pat. No. 3,835,737 to Carr which discloses a U-shaped head having a depending extension, the U-shaped head fitting into the blind end of the socket so that the extension can contact an inserted multi-faced fastener; and U.S. Pat. No. 4,060,113 to Matsushima which discloses a bow shaped spring which is inserted into a passage in the socket wall, a portion of which protrudes into the socket. The second class of retainer devices suffers from the disadvantage that by placing foreign objects into the socket, it is possible for jamming to occur, as well as interference with the proper operation of the socket with the multi-faced fastener. Additionally, excessive wear can be expected, since these devices involve considerable sliding friction when the multi-faced fastener is inserted and removed.

The third class of retainer devices is represented by U.S. Pat. No. 2,256,012 to Blair which discloses an automatic tool for supplying and driving female multi-faced fasteners. A first set of plungers at the forward end of the multi-faced fastener and a second set of plungers at the rearward end thereof provide for selection of which nut is currently available for use in a fastening operation. By this provision, a series of multi-faced fasteners can be held ready for use while the one which is currently in use is held in position by the first and second sets of plungers. Other examples of this class of retainer devices include: U.S. Pat. No. 1,655,168 to Speckman which discloses a wrench having a sliding retainer member which utilizes lip interference to hold the nut on the wrench; U.S. Pat. No. 2,631,485 to Stuart et al which discloses a plurality of jaw dogs that are jammed against the multi-faced fastener as it is inserted into the socket; U.S. Pat. No. 2,927,491 to Bochman, Jr. which discloses a magazine feed driver having retaining balls which coact with movement of a sleeve relative to a cam for regulating release of each multi-faced fastener; U.S. Pat. No. 3,379,231 to Gallo, Sr. which discloses a driving tool having a plurality of clamping jaws which hold a received multi-faced fastener in position for driving; U.S. Pat. No. 3,416,395 to Hanson which discloses a lug wrench that retains lugs in its barrel by action of spring biased balls; U.S. Pat. No. 3,707,894 to Stillwagon, Jr. which discloses cylindrical magnets used to grip a magnetizable multi-faced fastener and its washer; U.S. Pat. No. 3,808,918 to Carr which discloses a magnetic keeper retained at the blind end of a socket; and U.S. Pat. No. 4,474,090 to Berecz which discloses a nut feeding tool having nut regulation controlled by spherical balls moved by a sleeve in conjunction with a cam. This third class of retainer devices suffers from the disadvantage that it is not practical to utilize any form of projecting members which overlappingly interfere with the multi-faced fastener because this will correspondingly interfere with the insertion of the multi-faced fastener into the socket. Additionally, devices utilizing magnetism are undesirable because frequently it is required that the multi-faced fastener inserted into the socket not become magnetized and, further, frequently nylon or other non-magnetic types of multi-faced fasteners may be used, in which case a magnetic keeper is useless.

Accordingly, there continues to remain in the art the need to provide a simple, effective, reliable, and inexpensive socket retainer device for multi-faced fasteners which prevents both slipping and drooping of a received multi-faced fastener irrespective of the orientation of the socket, provides easy insertion and removal of the multi-faced fastener, and assures long life and excellent mechanical properties of the socket.

SUMMARY OF THE INVENTION

The present invention is a socket for multi-faced fasteners such as nuts, bolts, and the like having at least one resiliently biased rollably mounted retainer pin which interacts with a face of the multi-faced fastener to keep the multi-faced fastener in axial alignment with the socket irrespective of the orientation of the socket.

An annular rim is provided integral with the socket wall. The socket defined by the socket wall may be either hexagonal, square or other polygonal shape, hexagonal being preferred. The annular rim has an annular slot along its periphery. The annular rim and socket wall have at least one cut-out contiguous a respective face of the socket, the cut-out having a width exceeding the width of the respective face of the socket. In the preferred embodiment in which an hexagonal socket is used, the preferred number of cut-outs is three, each of which are located at every other face of the socket. A retainer pin is located in each cut-out adjacent its respective face of the socket. A retainer key having a straight edge and an opposite, curved edge is located in each cut-out, the straight edge abutting a respective retainer pin. At least one resilient ring is located in the annular slot on the periphery of the annular rim. A preferred material for the resilient ring is a resilient elastomer plastic or rubber. The resilient ring biases against the curved edge of each retainer key, causing each respective retainer pin to resiliently protrude into its respective face of the socket.

In operation, when a multi-faced fastener is received by the socket, the retainer pins retractably respond by applying a biasing force thereto along a cross section which is transverse to the axis of the socket at each abutting face of the multi-faced fastener. As a result of the biasing force applied by the retainer pins, the multi-faced fastener will be kept in axial alignment with respect to the socket irrespective of the orientation of the socket.

Accordingly, it is an object of the present invention to provide a socket tool for receiving a bolt, nut, and the like which includes a socket having a retainer for releasably retaining the bolt, nut, and the like in axial alignment with the socket of the socket tool irrespective of the orientation of the socket.

It is a further object of the present invention to provide a socket tool having a socket including a retainer for retaining a received bolt, nut, and the like in which the retainer abuts a cross section of at least one face of the received bolt, nut, and the like, the cross section being transverse to the axis of the socket.

It is another object of the present invention to provide a socket tool having a socket including a retainer for retaining a received bolt, nut, and the like which provides for easy insertion and removal of the bolt, nut, lag screw and the like relative to the socket, as well as low wear, long life, and excellent mechanical properties of the socket.

These and other objects, advantages, features, and benefits of the present invention will become apparent from the following specification.

DETAILED DESCRIPTION OF THE PREFERRED EMBODIMENT

Figure 1:
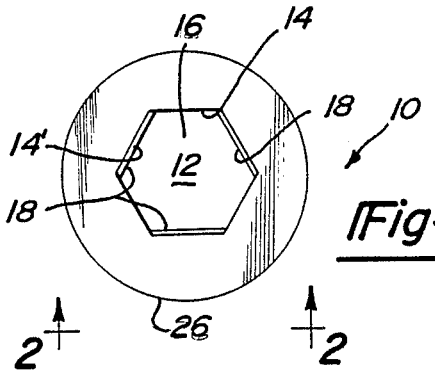
FIG. 1 is a plan view of the socket tool according to the present invention.

Referring now the figures, FIG. 1 shows the socket tool 10 according to the present invention. The socket tool has an hexagonally shaped socket 12, each face 14 of which is of equal dimensions. The socket 12 terminates interiorly preferably, but not mandatorily, in a floor 16. As can be seen from the figure, every other face 14' has a retainer pin 18 protruding thereinto, the exact nature of which will be explained hereinbelow. It is to be understood that the socket 12 is structured to mechanically cooperate with a standard bolt, nut, lag screw, stud and the like, hereinafter referred to as a multi-faced fastener, in which the multi-faced portion thereof is received into the socket, the faces 14 and 14' of the socket 12 complementarily cooperating with the faces of the multi-faced fastener for purposes of providing mechanical interconnection for driving or holding the multi-faced fastener in an otherwise conventional manner.

Figure 2:
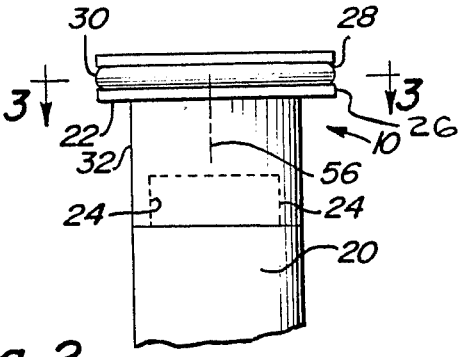
FIG. 2 is a part sectional side view of the socket tool along lines 2—2 in FIG. 1.
Figure 3:
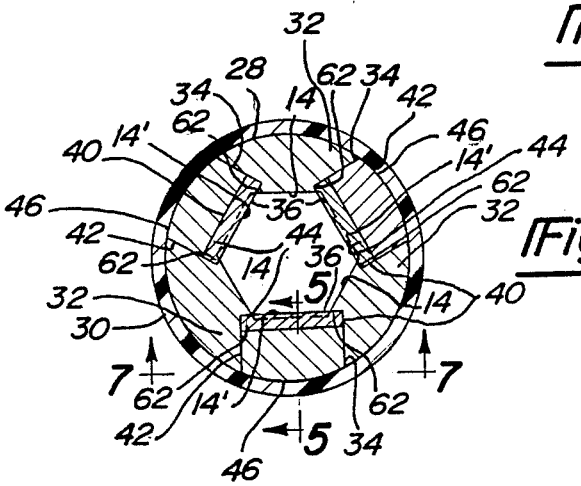
FIG. 3 is a part sectional plan view of the socket tool along lines 3—3 in FIG. 2.
Figure 4:
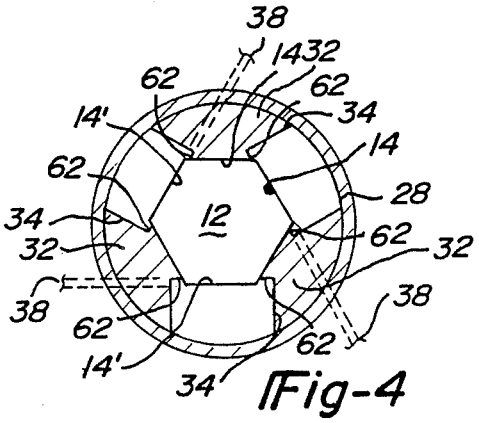
FIG. 4 is a part sectional plan view of the socket tool of FIG. 3, with the retainer pin, retainer key, and resilient ring components removed.

FIG. 2 shows the socket tool connected in a conventional manner to a driver 20, which may be, for example, a socket wrench or an automated assembly tool. The type of aforesaid conventional connection may include a square seat 24 in the socket tool which is adapted to receive a square shank 24' of the driver. It will be seen from FIG. 2 that there is an annular rim 22 at the socket end of the socket tool 10 located remote from the driver tool 20. At the periphery 26 of the annular rim is located an annular slot 28. Within the annular slot is located at least one resilient ring 30, made preferably of an elastomer plastic or rubber material. While one resilient ring is shown in the Figures, it is further preferred to use two resilient rings in combination positioned side-by-side within the annular slot. The purpose of the resilient ring will become clear from the discussion hereinbelow.

Figure 5:
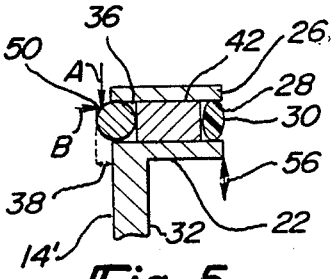
FIG. 5 is a fragmentary sectional side view of the socket tool along lines 5—5 in FIG. 3.
Figure 6:
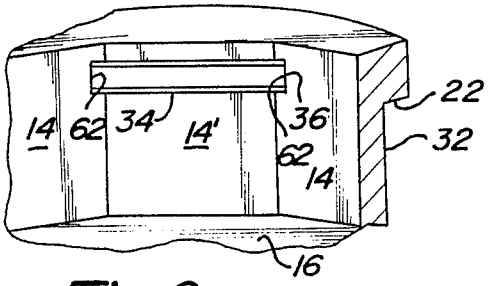
FIG. 6 is a fragmentary perspective view of a socket face of the socket tool according to the present invention.
Figure 7:
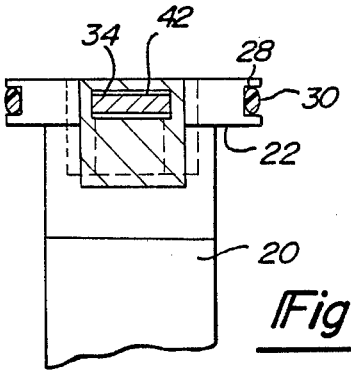
FIG. 7 is a part sectional side view of the socket tool and socket driver tool along lines 7—7 in FIG. 3.
Figure 8:
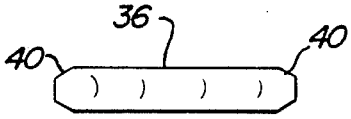
FIG. 8 is a detail plan view of the retainer pin according to the present invention.
Figure 9:
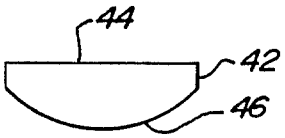
FIG. 9 is a detail plan view of the retainer key according to the present invention.
Figure 10:
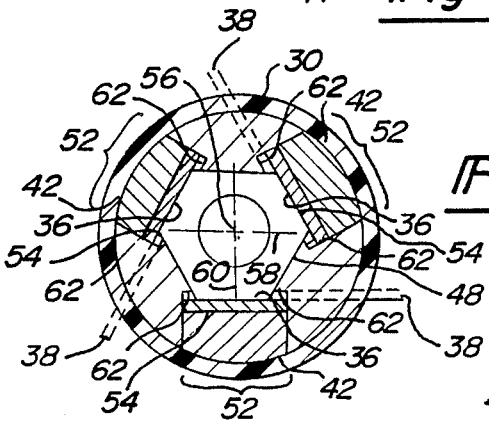
FIG. 10 is a part sectional plan view of the socket tool as in FIG. 3, now with a bolt head inserted thereinto.

FIGS. 3 through 7 show generally the construction of the socket tool 10. The annular rim 22 and the adjacent socket wall 32 are provided with three generally rectangularly shaped cut-outs 34, each being contiguous the annular slot 28 and the socket 12. Every other face 14' is provided with an aforesaid cut-out. Within each cut-out 34 a retainer pin 36 is located which, because the cut-out extends a distance 38 into the socket wall 32 beyond the face 14', as shown most clearly in FIG. 4, the retainer pin protrudes by this amount into the socket 12. The configuration of the retainer pin is that of an elongated cylinder as shown in FIG. 8. The retainer pin is preferred to have beveled ends 40. Each cut-out 34 extends across a cross section of the socket face 14' in an orientation which is transverse to the socket longitudinal axis 56, as shown in FIGS. 5 and 10. Further, each cut-out extends partially into adjacent socket faces 14 on either side of the socket face 14' so that the socket faces 14 each form an abutment 62 for the retainer pin to define the distance 38. Each retainer pin 36 likewise extends transversely across a cross section of the socket face 14' with respect to the socket longitudinal axis 56. In order to keep the retainer pins resiliently biased into the socket 12, a retainer key 42 is provided for each cut-out 34, to transmit to each respective retainer pin the force of contraction of the resilient ring 30, the location of the retainer key 42 being between the resilient ring and the retainer pin. The configuration of the retainer key 42 is that of a half-moon shape in which one end 44 is straight and an opposite end 46 is curved, as shown in FIG. 9. As can be seen from FIGS. 3, 5, 6 and 7, the retainer key is dimensioned so that the curved end 46 matches the radius of curvature of the annular slot 28. Accordingly, the resilient ring 30 biases against the curved end 46 of the retainer key 42, which in turn biases against its respective retainer pin 36 resulting in the retainer pin being resiliently biased so as to protrude into the socket by the distance 38.

It is to be understood that the location of the abutment 62 in each of the adjacent socket faces 14 can be adjusted so that the retainer pin 36 will protrude a predetermined distance into the socket, the predetermined distance being such as to provide desired operational characteristics of the socket for use with a given driver tool and a given multi-faced threaded fastener. Particularly in this regard, it should be noted that conventional spherical retainers are limited in that they may protrude into the socket at most a distance which is less than their diameter. This is because spherical retainers must be held in position by abutment surfaces that are separated by less than the diameter of the spherical retainer. Advantageously, therefore, the socket tool according to the present invention does not suffer from the aforesaid limitation of the spherical retainer. Accordingly, it is possible to locate the abutment 62 in each socket face 14 such that the retainer pin 36 protrudes into the socket 12 a predetermined distance which exceeds the diameter of the retainer pin.

Figure 12:
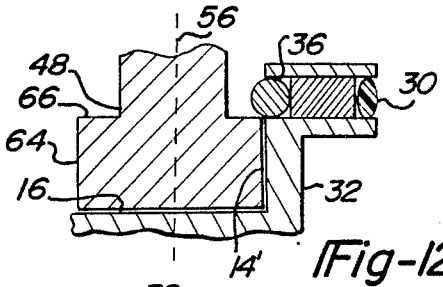
FIG. 12 is a fragmentary sectional side view of the socket tool as in FIG. 5, now including a multi-faced fastener being retained therein.

Operation of the socket tool 10 will now be described with reference to FIGS. 1, 3, 10, and 12. As can be seen from FIGS. 1 and 3, the resilient ring in combination with each of the retainer keys 42, respectively, biases each of the retainer pins 36 into the socket 12 by a distance 38. When a multi-faced fastener 48, shown in FIG. 10 as a bolt having an hexagonally shaped head, is inserted into the socket 12, the retainer pins are caused to retract into the rectangularly shaped cut-outs 34 so that they become flush with the socket face 14'. As the multi-faced fastener 48 is inserted into the socket, the retainer pins are free to rotate, thereby minimizing wear. Further, the retainer pins interact with the multi-faced fastener along a curved cylindrical surface 50, shown in FIG. 5. The multi-faced fastener forces the retainer pin both downwardly and sidewardly as shown by arrows A and B, respectively, in FIG. 5. The net result is a retractable movement of the retainer pin 36 into the rectangularly shaped cut-out 34, thereby moving the retainer key 42 against the biasing force of the resilient ring 30. Because of this movement, the resilient ring is caused to bow in the regions 52 adjacent the retainer keys, thereby applying an increased biasing force on the retainer pins toward the socket 12. Upon seating of the multi-faced fastener 48 into the socket, as shown in FIG. 10, the retainer pins 36 press against the opposing faces 54 of the multi-faced fastener, causing the multi-faced fastener to be aligned with the axis 56 of the socket 12 as well as producing a retention force which keeps the multi-faced fastener within the socket. Alternatively, as shown in FIG. 12, the head 64 of the multi-faced fastener 48 may extend, when inserted into the socket 12, between the floor 16 of the socket and the retainer pins 36. In this case, the retainer pins will serve to align the multi-faced fastener with the socket longitudinal axis 56 both by direct action of the retainer pins 36 on the lip 66 of the head of the multi-faced fastener, as well as cooperative action of the floor 16 of the socket 12 when the retainer pins force the head 64 thereagainst. It is to be understood, therefore, that the present invention provides a simple, durable and effective structure which both aligns and retains the multi-faced fastener within the socket, and at the same time allows for easy insertion and removal thereof with respect to the socket.

Figure 11:
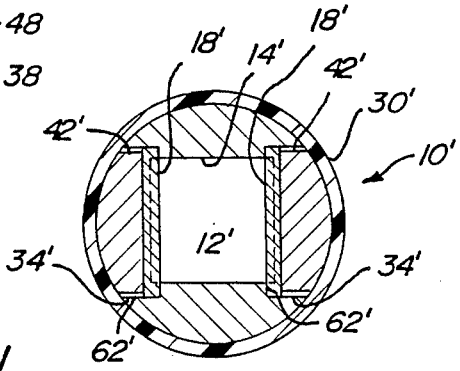
FIG. 11 is a part sectional plan view of an exemplary structure of a four faced socket tool according to the present invention.

FIG. 11 shows the socket tool 10' adapted for receiving a square shaped multi-faced fastener. The socket 12' has four faces 14" and two oppositely facing cut-outs 34'. The retainer pin 18, and the retainer key 42' are located in each of the cut-outs. The resilient ring 30' is located, and functions with respect to the retainer pins and the retainer keys, as hereinabove described for the hexagonally shaped socket 12. The hexagonally shaped socket 12 is preferred over the square shaped socket 12' in that a received multi-faced fastener will be biased radially inwardly along both transverse axes, as shown in FIG. 10, 58 and 60 relative to the socket axis by action of the retainer pin so as to align the multi-faced fastener irrespective of the orientation of the socket 12.

To those skilled in the art to which this invention appertains, the above described preferred embodiment may be subject to change or modification. For instance, the periphery 26 can be located so that the annular slot 28 is formed directly on the socket wall 32, and other forms of biasing devices can be used other than the resilient ring 30. Such changes or modifications can be carried out without departing from the scope of the invention which is intended to be limited only by the scope of the appended claims.

What is claimed is:

1. A socket tool for being driven by a driver, said socket tool comprising:

a socket defined by a wall, said wall having integral therewith a periphery, said periphery having an annular slot located therein, said socket having a plurality of faces forming an hexagonal shape, said socket further having a longitudinal axis;

three cut-outs in said wall of said socket, each cut-out of said three cut-outs being located at a respective face of said plurality of faces, one said respective face being positioned at every other face of said plurality of faces, said each cut-out being contiguous said periphery and said socket, said each cut-out being generally rectangular in shape, said each cut-out further being contiguous said respective face of said socket and partially contiguous each face of said plurality of faces that is adjacent said respective face of said socket;

a retainer pin located in each said cut-out, said retainer pin being oriented in parallel relation with respect to said respective face of said socket, said retainer pin further being oriented in transverse relation with respect to said longitudinal axis of said socket, said retainer pin having generally cylindrical shape;

abutment means in said wall for preventing said retainer pin from protruding into said socket further than a predetermined distance, said abutment means comprising an abutment formed adjacent each face of said plurality of faces that is adjacent said respective face of said socket;

a retainer key in each said cut-out, said retainer key being located adjacent said retainer pin, said retainer key having a straight end abutting said retainer pin, said retainer key further having a curved end opposite said straight end thereof, said curved end of said retainer key having a radius of curvature substantially equal to that of said annular slot;

at least one resilient ring located in said annular slot in said periphery, said at least one resilient ring resiliently biasing against said retainer key to cause said retainer pin to protrude into said socket; and means located at one end of said socket tool for connecting said socket tool to said driver.

2. The socket tool of claim 1, further comprising an annular rim integral with said wall of said socket, said periphery being located on said annular rim.

3. A socket tool and driver, comprising:

a socket defined by a wall, said wall having integral therewith a periphery, said periphery having an annular slot located therein, said socket having a plurality of faces forming a polygonal shape, said socket further having a longitudinal axis;

a plurality of cut-outs in said wall of said socket, each cut-out of said plurality of cut-outs being located at a respective face of said plurality of faces, one said respective face being positioned at every other face of said plurality of faces, said each cut-out being contiguous said periphery and said socket, said each cut-out being generally rectangular in shape, said each cut-out further being contiguous said respective face of said socket and partially contiguous each face of said plurality of faces that is adjacent said respective face of said socket;

a retainer pin located in said each cut-out, said each retainer pin being oriented in parallel relation with respect to said respective face of said plurality of faces of said socket, said retainer pin further being oriented in transverse relation with respect to said longitudinal axis of said socket, said retainer pin having a generally cylindrical shape;

abutment means in said wall for preventing said retainer pin from protruding into said socket further than a predetermined distance, said abutment means comprising an abutment formed adjacent each face of said plurality of faces that is adjacent said respective face of said socket;

a retainer key in said each cut-out, said retainer key being located adjacent said retainer pin, said retainer key having a straight end abutting said retainer pin, said retainer key further having a curved end opposite said straight end thereof, said curved end of said retainer key having a radius of curvature substantially equal to that of said annular slot;

at least one resilient ring located in said annular slot in said periphery, said at least one resilient ring resiliently biasing against said retainer key to cause said retainer pin to partially protrude into said socket; and a driver for driving said socket tool, said driver being connected with one end of said socket tool.

4. The socket tool and driver of claim 3, wherein said polygonal shape of said socket comprises an hexagonal shape, and said plurality of cut-outs comprises three cut-outs.

5. A socket tool for rotatably driving a multi-faced fastener comprising:

a socket wall structure having a female socket cavity therein, said female socket cavity having a socket axis, said female socket cavity further defining a plurality of fastener river faces extending parallel to said socket axis:

at least one cut-out extending radially outwardly from at least one of said fastener driver faces of said plurality of driver faces within said socket wall structure, said at least one cut-out extending radially outwardly in a plane normal to said socket axis, said at least one cut-out defining a straight-surfaced guideway having a guide axis extending normal to said associated fastener drive face;

at least one cylindrical pin slidably disposed in said at least one cut-out for selective radial movement relative to said associated fastener driver face, said a least one cylindrical pin being slidably movable to extend radially inward of said associated driver face to have pressure engagement with one face of said multi-faced fastener, said at least one cylindrical pin being rotatable in said cut-out about its longitudinal axis:

resilient means for biasing said at least one cylindrical pin toward said socket axis; and abutment means for limiting the inward radial movement of said at least one cylindrical pin so that said at least one cylindrical pin protrudes a predetermined distance into said female socket cavity.

6. The socket tool of claim 5 wherein said straight-surfaced guideway further comprises at least two minor guide faces and at least two major guide faces, and wherein said at least one cylindrical pin has a predetermined length that corresponds to the spacing between said at least two minor guide faces, whereby said at least one cylindrical pin is prevented from play in the direction along the axis of said at least one cylindrical pin.

7. The socket tool of claim 6 wherein said resilient means for biasing comprises a force-applying member slidably positioned in each said guideway to engage a cylindrical surface area of said associated cylindrical pin.

8. The socket tool of claim 5 further comprising an annular circumferential slot formed in an outer peripheral face of said socket wall structure, and wherein said resilient means for biasing further comprises at least one resilient elastomeric ring seated in said annular circumferential slot.

9. The socket tool of claim 5 wherein said socket wall structure has an annular circumferential slot in its outer peripheral face; said resilient means for biasing comprising a resilient elastomeric ring seated in said annular circumferential slot and force-applying member slidably positioned in each guideway between said associated cylindrical pin and an inner surface of said resilient elastomeric ring.

10. The socket tool of claim 5 wherein said female socket cavity is configured to form six driver faces; alternate ones of said driver faces having rectangular cut-outs associated therewith

11. The socket tool of claim 5 wherein said female socket cavity is configured to form four driver faces; alternate ones of said driver faces having rectangular cut-outs associated therewith.

12. The socket tool of claim 5 wherein said socket wall structure has a radial rim flange extending outwardly therefrom, said radial rim flange having a circular edge profile when viewed in a plane normal to said socket axis; an annular circumferential slot formed in said radial rim flange; said resilient means for biasing comprising at least one resilient elastomeric annular ring seated in said annular slot and a force-applying member slidably positioned in said straight-surfaced guideway between said resilient elastomeric annular ring and said at least one cylindrical pin.

13. A socket tool for rotatably driving a multi-faced fastener comprising:

a socket wall structure having a female socket cavity therein, said female socket cavity having a socket axis, said female socket cavity further defining a plurality of fastener driver faces extending parallel to said socket axis;

at least one cut-out extending radially outwardly from at least one of said fastener driver faces of said plurality of driver faces within said socket wall structure, said at least one cut-out having a pair of spatially separated major guide faces and at least two spatially separated minor guide faces forming the side faces of said at least one cut-out, said pair of spatially separated major guide faces extending radially outwardly in a plane normal to said socket axis, said pair of spatially separated major guide faces and said at least two spatially separated minor guide faces defining a straight-surfaced guideway having a guide axis extending normal to said associated fastener driver face;

at least one retainer member slidably disposed in said at least one cut-out for selective radial movement relative to said associated fastener driver face, said at least one retainer member having a contoured surface slidably movable to extend radially inward of said associated drive face to have pressure engagement with said fastener, said at least one retainer member further having a width corresponding to the spacing between said at least two spatially separated minor guide faces whereby said at least one retainer member is prevented from play in a direction normal to said at least two spatially separated minor guide faces;

resilient means for biasing said at least one retainer member toward said socket axis; and abutment means for limiting the inward radial movement of said at least one retainer member so that said at least one retainer member protrudes a predetermined distance into said female socket cavity.

14. The socket tool of claim 13 wherein said at least one cut-out has a cross-sectional height dimension defined by the spacing between said pair of spatially separated major guide faces and a cross-sectional width dimension defined by the spacing between said at least two spatially separated minor guide faces; said with dimension of said at lest one cut-out being greater than the corresponding dimension of said associated fastener driver face so that the radially innermost end of said at least one cut-out defines said abutment means.

15. The socket tool of claim 3 wherein said at least one retainer member comprises a cylindrical pin extending crosswise of said guide axis, said cylindrical pin being rotatable about its longitudinal axis in said cut-out.

* * * * *

UNITED STATES PATENT AND TRADEMARK OFFICE

CERTIFICATE OF CORRECTION

PATENT NO. : 4,934,226

DATED : June 19, 1990

INVENTOR(S) : Ernest A. Dacey, Jr.

It is certified that error appears in the above-identified patent and that said Letters Patent is hereby corrected as shown below:

Column 7, line 11, delete ", as shown".

Column 7, line 12, delete "in Fig. 10,", same line, after "axis", insert ---- , as shown in Fig. 10, ----.

Column 7, line 50, after "having" insert ---- a ----.

Column 8, line 59, delete "river" and insert ---- driver -----.

Column 8, line 68, delete "drive" and insert ---- driver ----.

Column 9, line 46, after "therewith" insert a period ---- . ----.

Column 10, line 30, delete" drive" and insert ---- driver ----.

Column 10, line 50, delete "lest" and insert ---- least ----.

Column 10, line 49, delete "with" and insert ---- width ----.

Signed and Sealed this

Fifth Day of May, 1992

*Attest:*

*Attesting Officer*

DOUGLAS B. COMER

*Acting Commissioner of Patents and Trademarks*